United States Patent [19]

Ruscoe et al.

[11] 4,279,968

[45] Jul. 21, 1981

[54] COINS AND SIMILARLY DISC-SHAPED ARTICLES

[75] Inventors: Michael J. H. Ruscoe, St. Albert; Kshitindra M. Sarkar, Saskatoon; Maurice A. Clegg, Fort Saskatchewan, all of Canada

[73] Assignee: Sherritt Gordon Mines Limited, Toronto, Canada

[21] Appl. No.: 176,944

[22] Filed: Aug. 11, 1980

Related U.S. Application Data

[62] Division of Ser. No. 31,709, Apr. 20, 1979.

[51] Int. Cl.[3] ..... B32B 15/00

[52] U.S. Cl. ..... 428/677; 40/27.5; 428/926; 428/935

[58] Field of Search ..... 428/677, 926, 935; 40/27.5

[56] References Cited

U.S. PATENT DOCUMENTS

| | | | |
|---|---|---|---|
| 3,636,616 | 1/1972 | Remning et al. | 40/27.5 |
| 3,750,253 | 8/1973 | Miller | 428/677 |

*Primary Examiner*—M. J. Andrews

*Attorney, Agent, or Firm*—Robert F. Delbridge; Arne I. Fors

[57] ABSTRACT

A blank suitable for minting to form a coin or similarly disc-shaped article has an appropriately disc-shaped steel core completely encased by a copper coating electroplated thereof. The blank is produced by electroplating a copper coating onto an appropriately disc-shaped steel core such that the copper coating completely encases the steel core.

1 Claim, No Drawings

COINS AND SIMILARLY DISC-SHAPED ARTICLES

This is a division of application Ser. No. 031,709 filed Apr. 20, 1979.

This invention relates to coins and similarly disc-shaped articles, such as medals, or medallions.

The metallic composition of coins has varied over the years owing to the escalating cost of the metals or alloys from which coins have conventionally been made. For example, gold coins are now virtually extinct, and silver coins may frequently contain copper and/or other metals to reduce the metallic value of the coin compared to its face value, while still giving it a silver-like appearance. Another kind of coinage in frequent use is copper coinage, which is made of copper or a copper alloy. As compared to silver and gold coinage, of course, copper coinage is usually used for coins of lower value in a monetary system.

With the increasing cost of metals, the value of the metal of which a coin is made may increase so much that it approaches or even exceeds the face value of the coin, with the result that it can be advantageous to melt down such coins and obtain the current price of their contained metals. It is primarily for this reason that, for example, coins made of silver have now been replaced by coins made of other metals or alloys of similar appearance and lower intrinsic values, such as nickel or nickel alloys.

Until now, this problem has not become particularly significant with respect to copper coinage, since the value of the copper or copper alloy of which the coins are made has remained small compared to the face value of the coins. However, with the escalating cost of copper and its alloys, this problem has now become relevant with respect to copper coinage, with the result that it is now desirable to find some alternative composition or construction for copper coins. Because most countries are reluctant to change the appearance of their coins, it is at the same time necessary to preserve the copper-like appearance of such coins, as was done in the case of silver coins, where the silver-like appearance of the coins was preserved by a suitable choice of metal or alloy for at least the faces of the coin.

According to the present invention, a blank suitable for minting to form a coin or similarly disc-shaped article is produced by electroplating a copper coating onto an appropriately disc-shaped steel core such that the copper coating completely encases the steel core. The blank is subsequently minted by applying the required insignia to one or both faces of the blank by means of an appropriately designed die or dies. Where a coin is to be produced, the size of the core and the thickness of the copper coating will of course be such as to produce a blank of the same size as a conventional copper coin which it is intended the coin according to the present invention should replace.

Steel is considerably less expensive than copper, and the metallic value of a coin according to the present invention is considerably less than the metallic value of a conventional copper coin of the same size and made entirely of copper and/or copper alloy. Also, the seigniorage of a coin according to the invention, that is to say the difference between the face value of the coin and the cost of producing it (including the cost of raw materials), is sufficient for the present invention to constitute an attractive alternative process for producing coins of copper-like appearance. Further, since the exterior of the coin is copper, its appearance will resemble that of a conventional copper coin, and will not become substantially different therefrom over a period of time. If desired, alloying elements may be included in the copper coating to increase wear or corrosion resistance.

In order to produce a coin of satisfactory hardness and wear resistance for the usage which a coin experiences, while at the same time permitting the blank to be readily imprintable with the required insignia by means of an appropriately designed die or dies, the steel is preferably a low carbon steel. Advantageously, the carbon content of the steel is less than about 0.05%, a preferred value being of the order of 0.01%.

Many coins have raised rims around the peripheries of opposed faces, and these raised rims are preferably formed on the steel cores before the electroplating step.

Advantageously, the electroplating step includes loading a plurality of cores into a perforated container, placing the container in an electroplating bath, and electroplating the copper coating onto the cores while moving the container angularly about a horizontal axis.

An intermediate coating of another metal, such as nickel or zinc, may be electroplated directly onto the steel core, with the copper coating then being electroplated directly onto the intermediate metal coating. The intermediate metal coating may also be electroplated onto the cores by use of a perforated container in an electroplating bath, as mentioned above in connection with the copper coating.

The copper coating preferably has a thickness of at least 0.05 mm on each opposed face of the core, and a thickness on the peripheral edge of the core measured radially in the range of from about 2 to about 4 times the face thickness. The intermediate metal coating preferably has a thickness in the range of at least about 0.005 mm on each opposed face and the thickness on the peripheral edge of the core measured radially in the range of from about 2 to about 4 times the face thickness.

After the copper coating has been electroplated onto the core, the blank is preferably heated to form a layer of interdiffused copper and steel with consequent metallurgical bonding of the copper coating to the core. Where an intermediate metal coating is provided, such heating is caused to form a layer of interdiffused copper and intermediate metal and also a layer of intermediate metal and iron with consequent metallurgical bonding of the copper coating to the intermediate coating and of the intermediate coating to the core.

The heating step may also be used to decrease the hardness of the steel core to a value more suitable for minting, for example less than about 65, and preferably less than about 45 on the Rockwell 30T hardness scale.

In one embodiment of the invention, a batch of coinage cores was made of low carbon steel, namely steel manufactured by Dofasco and sold by them as ASTM A424 type I, the maximum carbon content of such steel being 0.01% by weight. The circular steel cores of appropriate diameter were punched out of steel strip of appropriate thickness, namely about 1.2 mm and were given a raised rim around the periphery of both faces by an upsetting operation. The steel cores were loaded, as a 60 kg batch, into a perforated barrel made of polypropylene 91 cm long and 46 cm in diameter. This 60 kg batch of cores contained about 13,000 cores.

The steel cores were then put through a cleaning cycle by lowering the barrel into successive baths providing rinses of 5% neutral detergent solution, hot water, cold water, 10% HCl and cold water respectively. In each instance, the barrel was immersed in the bath with its longitudinal axis horizontal, and was oscillated over nearly 180° about its longitudinal axis at about six to and fro cycles per minute. The barrel was then immersed in a nickel sulphamate plating bath containing about 98 grams per liter nickel, and oscillated as before. The temperature of the nickel plating bath was maintained at about 55° C. and the pH was maintained at about 2.1. Flexible cathode rods were mounted within the barrel, and baskets containing nickel anode pieces were supported in the plating bath externally of the barrel. A voltage of 12V was applied, giving a current of 290A.

After 1.5 h, a 2.8 kg sample of nickel-plated cores was withdrawn from the barrel and rinsed in water. The thickness of nickel coating on the faces of these cores was found to be 0.003 mm. After a further 1.5 h, a 3.8 kg sample of nickel-plated cores was withdrawn from the barrel, and the nickel coating thickness was found to be 0.006 mm on the core faces and 0.02 mm on the circumferential rims. Laboratory test show that the nickel coating thickness of 0.003 mm on the first sample of cores was inadequate for subsequent copper plating.

The second sample of nickel plated cores was then placed in a smaller barrel having a length of 30 cm and a diameter of 15 cm. The second barrel was then immersed in an acid copper sulphate plating bath containing 45 grams per liter copper and the barrel was continuously rotated at 6 r.p.m. Flexible cathode rods were mounted within the barrel, and baskets containing copper anode pieces were supported in the bath externally of the barrel.

This plating bath was maintained at a temperature of 40° C. and a pH of 1. The nickel plated cores were plated with copper for 13.5 h at a voltage of 3V and a current of 40A and, after this time, a copper coating of 0.06 mm was deposited on the nickel-plated core faces, with a copper coating of 0.14 mm having been deposited on the circumferential rims. After the copper plating, the resultant blanks were rinsed and dried.

The blanks were then annealed in a pure hydrogen atmosphere at a temperature of 800° C. for 30 min., and allowed to cool in the same atmosphere. An analysis of the annealed blanks is shown in Table 1.

Metallography showed the plating of the cores to be free from any significant defects, with there being good adhesion between the copper and nickel coatings and between the nickel coating and the steel core.

Some of the blanks were minted, by applying appropriate insignia to both faces of the blanks by means of dies, and excellent results were achieved. To provide a coin of high lustre, it may be advantageous to burnish the blanks before minting, for example, by burnishing in a soap solution containing metallic media.

The barrel in the copper plating bath may be oscillated, as was the barrel in the nickel plating bath, rather then continuously rotated.

It will be understood that the invention is applicable to the production of other disc-shaped articles, as well as coin blanks. Medals and medallions are examples of other disc-shaped articles to which the invention is applicable. Also, such articles may not necessarily have a circular periphery and may not necessarily be imperforate.

Other embodiments within the scope of the invention will be apparent to a person skilled in the art, the scope of the invention being defined in the appended claims.

What we claim as new and desire to protect by Letters Patent of the United States is:

1. A blank suitable for minting into a coin or similarly disc-shaped article comprising a disc-shaped steel core, an intermediate metal coating electroplated on and encasing the core, said intermediate metal being selected from the group consisting of nickel and zinc, and said intermediate metal coating having a thickness of at least about 0.005 mm on each opposed face of the core and a thickness on the peripheral edge of the core measured radially in the range of from about 2 to about 4 times the face thickness, and a copper coating electroplated on and encasing the intermediate coating and core, the copper coating having a thickness of at least about 0.05 mm on each opposed face of the core and a thickness on the peripheral edge of the core measured radially in the range of from about 2 to about 4 times the face thickness, the intermediate metal coating being metallurgically bonded to the core by a layer of interdiffused intermediate metal and steel, the copper coating being metallurgically bonded to the intermediate metal coating by a layer of interdiffused copper and intermediate metal, and the hardness of the steel core being less than about 65 on the Rockwell 30T hardness scale.

* * * * *

TABLE 1

| Cu % | Ni % | Fe % (by difference) | Weight (g) | Diameter (mm) | Thickness (mm) | Hardness R-30T | Nickel Plate on Face (mm) | Copper Plate on Face (mm) |
|---|---|---|---|---|---|---|---|---|
| 14.4 | 1.7 | 83.9 | 5.44 | 24.81 | 1.35 | 42 | 0.006 | 0.060 |